United States Patent [19]

Hirschberger et al.

[11] Patent Number: 4,760,683

[45] Date of Patent: Aug. 2, 1988

[54] BAG INSERTER

[75] Inventors: Baldur Hirschberger, Delta; Michael Mack, Richmond, both of Canada

[73] Assignee: Crown Forest Industries Limited, Vancouver, Canada

[21] Appl. No.: 25,324

[22] Filed: Mar. 12, 1987

[30] Foreign Application Priority Data

Nov. 21, 1986 [CA] Canada ..... 523598

[51] Int. Cl.[4] ..... B65B 41/13

[52] U.S. Cl. ..... 53/170; 53/248; 53/249; 53/255; 53/266 R; 53/505

[58] Field of Search ..... 53/55, 64, 67, 505, 53/245–248, 249, 250, 251, 255, 260, 266 R, 170

[56] References Cited

U.S. PATENT DOCUMENTS

| | | | |
|---|---|---|---|
| 2,633,280 | 3/1953 | Davies . | |
| 2,896,384 | 7/1959 | Carlsen et al. | 53/245 X |
| 3,105,333 | 10/1963 | Desnick . | |
| 3,370,549 | 2/1968 | Livingston . | |
| 3,766,706 | 10/1973 | Graham | 53/260 X |
| 4,010,595 | 3/1977 | Boyd | 53/55 |
| 4,228,635 | 10/1980 | Altenpohl . | |
| 4,250,688 | 2/1981 | Lingenfelder . | |
| 4,291,519 | 9/1981 | Johnson | 53/250 X |
| 4,302,919 | 12/1981 | Hartness | 53/250 |
| 4,428,175 | 1/1984 | Haab | 53/251 X |
| 4,492,070 | 1/1985 | Morse . | |
| 4,534,156 | 8/1985 | Smith | 53/260 X |
| 4,571,926 | 2/1986 | Scully | 53/260 X |
| 4,648,233 | 3/1987 | Holland | 53/251 X |

*Primary Examiner*—Robert L. Spruill
*Assistant Examiner*—Steven P. Weihrouch
*Attorney, Agent, or Firm*—Chernoff, Vilhauer, McClung & Stenzel

[57] ABSTRACT

A bag inserter for inserting a liquid filled bag into a preselected position within a container. A funnel receives and guides the bag into the container. The funnel has a bag receiving aperture for guiding the bag into a tapered bag forming section. The bag passes into a bag discharge chute beneath the bag forming section and then through a bag discharge aperture formed at a substantial vertical angle across the lower end of the chute. Container positioning means are provided for positioning a container to receive the bag with a bag receiving aperture of the container adjacent the discharge aperture and with a wall of the container opposite the container bag receiving aperture at approximately the same angle at which the bag discharge aperture intersects the bag discharge chute.

3 Claims, 7 Drawing Sheets

BAG INSERTER

FIELD OF THE INVENTION

This application pertains to bag inserter apparatus for inserting a liquid filled bag into a preselected position within a container.

BACKGROUND OF THE INVENTION

Traditionally, liquids such as wines have been packaged and sold in glass bottles. Bottles are however breakable, they are relatively heavy, and they consume a relatively large shipping volume which renders bottles somewhat disadvantageous as a packaging medium.

Recently, liquid filled pouches or bags packaged in cardboard containers have been adopted by some producers as an alternative for packaging liquids such as wines, ketchup, milk, milkshake and soft drink syrups, vinegar and water. The bags are filled with liquid, sealed and placed in cartons (which may be prelabelled), after which the cartons are packaged and palletized for shipment. The liquid filled bags are provided with a leak-proof, non-drip valve or tap, such that, when liquid is released from the filled bag, the bag collapses without allowing air to enter the bag. Thus, there is no oxidation of the liquid which remains in the bag, so the remaining liquid may be stored for a prolonged time. By contrast, air enters a conventional bottle as liquid is poured from the bottle. If the liquid in the bottle is affected by oxidization then it must be consumed relatively quickly to prevent spoilage. The rectangular shape and light weight of the carton in which the liquid filled bag is packaged provides a further advantage as compared with conventional bottles; namely, reduced shipping costs due to more efficient space utilization and weight reduction.

However, some problems have been experienced in packaging liquid filled bags. Each bag is typically equipped with a valve which the end user may manually activate to release a selected amount of liquid from the bag. The cartons in which the liquid filled bags are packaged are provided with aperture covers joined to the carton by perforated lines of weakness. The customer breaks the perforations to remove the aperture cover, thereby exposing the bag valve. It is of critical importance that the liquid filled bag be placed within the carton so that the bag valve is immediately adjacent the aperture cover for ready access by the customer.

Problems have also been experienced in conforming the shape of liquid filled bags to that of the containers into which the bags are inserted. Often, the bag edges protrude from the container after the bag is inserted into the container and the edges are subsequently caught or crimped by the container end panels when they are folded over and sealed to close the bag within the container. If this happens the customer may have difficulty positioning the bag valve in its proper orientation relative to the container aperture for release of liquid from the bag; or, the customer may have difficulty releasing all of the available liquid from the bag.

The present invention provides a bag inserter apparatus which is especially adapted to insert a liquid filled bag into a pre-selected position within a container. More particularly, the apparatus facilitates accurate placement of the bag within the container with the bag valve properly located relative to the container aperture cover and with the bag edges tucked inside the container away from the container end flaps.

SUMMARY OF THE INVENTION

In accordance with the preferred embodiment, the invention provides bag inserter apparatus for inserting a liquid filled bag into a pre-selected position within a container. The apparatus comprises a funnel for receiving and guiding the bag into the container. The funnel comprises a bag receiving aperture for guiding the bag into a tapered bag forming section of the funnel. The funnel also comprises a bag discharge chute located beneath the bag forming section, a bag deflector plate at the lower end of the chute, and a bag discharge aperture formed at a substantial vertical angle across the lower end of the chute. The apparatus further comprises container positioning means for offset positioning of a container relative to the chute, such that a bag receiving aperture of the container lies adjacent the funnel discharge aperture, with a wall of the container opposite the container bag receiving aperture at approximately the same angle at which the bag discharge aperture intersects the bag discharge chute.

Preferably, the apparatus further comprises container placement means for placing a container on the container positioning means, for subsequent positioning of the container adjacent the funnel by the container positioning means. Advantageously, the container placement means may comprise an extendible cylinder for stopping travel of the container at a selected position on the container positioning means. The cylinder is retractable, upon operation of the container positioning means, to restrain passage of additional containers toward the container positioning means. The cylinder is extendible to eject the container from the container positioning means after insertion of the bag into the container.

DETAILED DESCRIPTION OF THE PREFERRED EMBODIMENT

Figure 1:
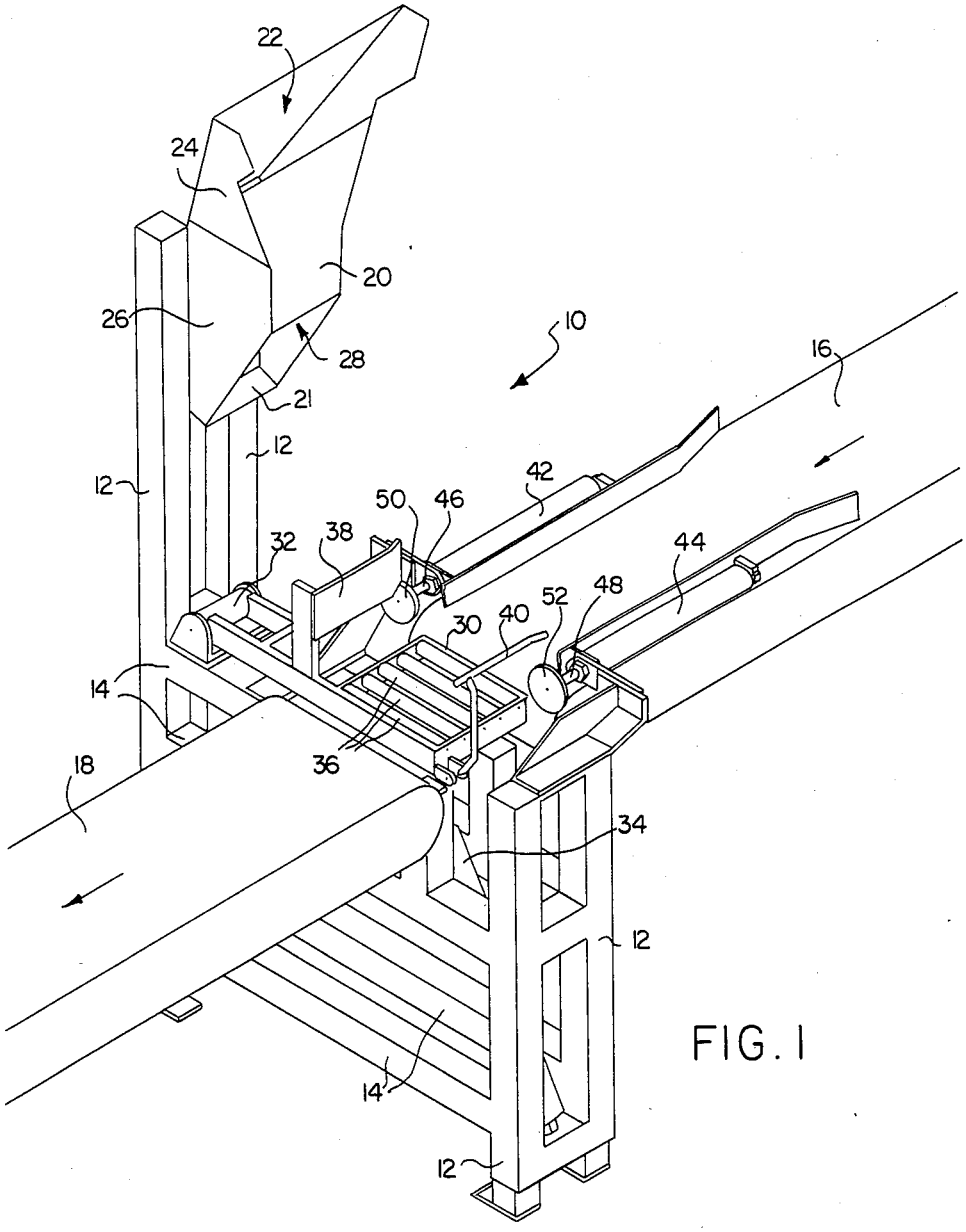
FIG. 1 is a pictorial illustration of the preferred bag inserter apparatus shown in position to receive empty containers from a first conveyor and to eject liquid filled bag-containing containers onto a second conveyor.
Figure 2:
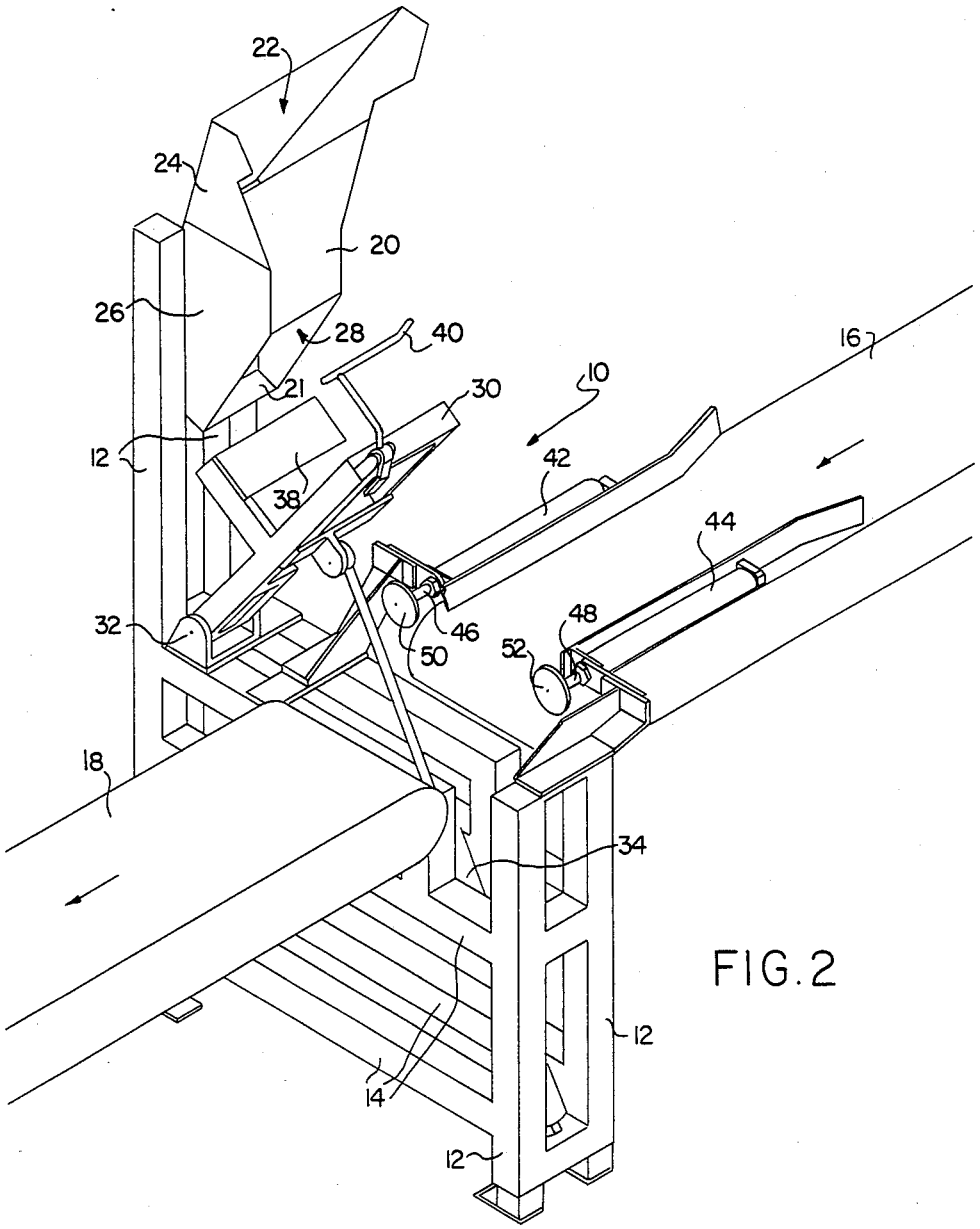
FIG. 2 is similar to FIG. 1, but shows the container positioning means actuated to position a container (not shown) adjacent the funnel.
Figure 3:
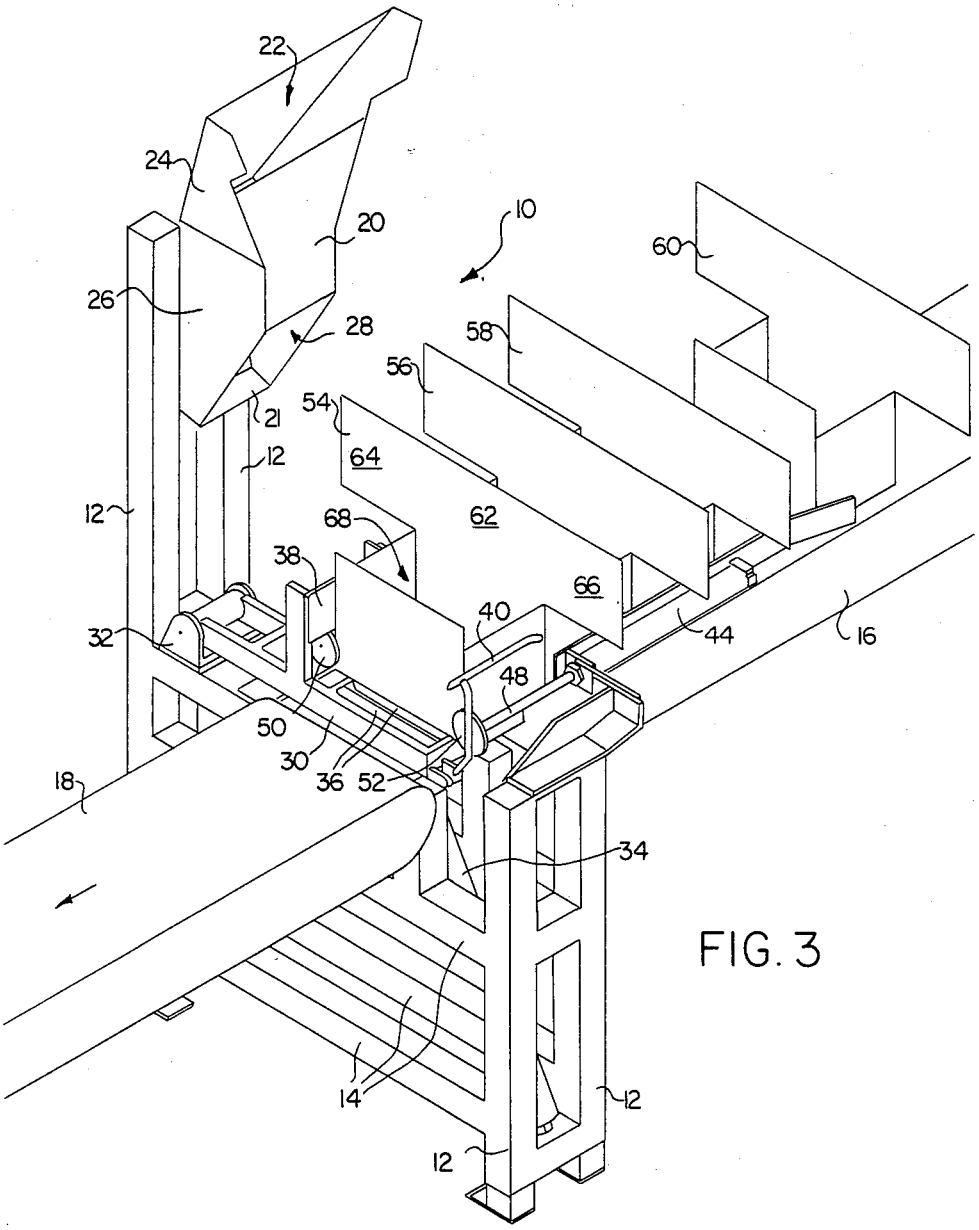
FIG. 3 is similar to FIG. 1, but shows a sequence of empty containers on the first conveyor, one of which has been placed in position on the container positioning means.

FIGS. 1 through 5 illustrate a bag inserter generally designated 10. Bag inserter 10 is supported by legs 12 and cross braces 14. The height of legs 12 is adjusted so that bag inserter 10 may receive empty containers from a first conveyor 16 and eject liquid filled bag-containing containers onto a second conveyor 18.

Bag inserter 10 incorporates a funnel 20 mounted near the top of upwardly extending legs 12 and to the rear of bag inserter 10. Funnel 20 has a relatively wide bag receiving aperture 22 for receiving a liquid filled bag 23 (shown only in FIG. 5) from bag filling and dispensing apparatus (not shown) and for guiding the bag into inwardly tapered bag forming section 24 of funnel 20. Bags delivered to funnel 20 by the bag filling and dispensing apparatus always enter bag receiving aperture 22 at a known orientation, due to the manner in which the liquid filled bags are dispensed. Accordingly, funnel 20 is shaped to preserve the orientation of the liquid filled bag so that the bag can be guided into a pre-selected position within a container without leaving any edges of the bag to be caught when the container is closed and sealed. This is accomplished by providing tapered bag forming section 24 with a gradual inward taper which gently "plumps" the liquid filled bag into a pillow-like shape as the bag passes down through bag forming section 24 and into bag discharge chute 26 located beneath bag forming section 24. The shape of the liquid filled bag which passes into bag discharge chute 26 is thus such that the bag may easily fit within a container without leaving any protruding bag ends. The sides of bag forming section 24 and bag discharge chute 26 provide firm support for the bag as it passes through funnel 20 so that the bag valve 27 (shown only in FIG. 5) remains at a known orientation and can thus be accurately positioned in the container relative to the container valve aperture 29 (shown only in FIG. 5 on container 54) through which the valve is subsequently to be drawn by the customer.

A bag discharge aperture 28 is provided in the lower end of bag discharge chute 26. Bag discharge aperture 28 is formed at a substantial vertical angle across the lower end of bag discharge chute 26 so that the bag, once formed within bag forming section 24 and bag discharge chute 26, falls directly into a container positioned adjacent bag discharge aperture 28, without enabling the bag to twist or otherwise disrupt the orientation of the bag valve, which must be positioned immediately adjacent the container valve aperture. The sides of bag discharge chute 26 and bag deflector plate 21 support the liquid filled bag as it is eased, by gravity, from funnel 20 into the container.

Bag inserter 10 further comprises "container positioning means" for offset positioning of an empty container relative to chute 26 with a bag receiving aperture of the container adjacent bag discharge aperture 28 and with a wall of the container opposite the container bag receiving aperture at approximately the same angle at which bag discharge aperture 28 intersects bag discharge chute 26. The container positioning means operates in two stages to ensure consistent, reliable placement of liquid filled bags into the containers. In the first stage, the liquid filled bag drops through funnel 20 into the container. Because the container is raised into a tilted or offset position with respect to the vertical path through bag discharge chute 26 traversed by the bag, the bag's lower ears are reliably and securely positioned into the lowermost end portion of the container as the bag drops through discharge aperture 28 into the container. In the second stage, the container positioning means lowers the container and this action reliably and securely propels the bag's upper ears into the opposed end portion of the container, leaving no portion of the bag protruding from the container. In the preferred embodiment, the container positioning means comprises a frame-like member 30 which is pivotally connected to the bag inserter frame as shown at 32. A pneumatic cylinder 34 is provided for raising member 30 and container 54 into the offset position shown in FIG. 4 to receive a bag from bag discharge aperture 28, and for lowering member 30, together with the bag-filled container, to return member 30 and the container to the position depicted in FIG. 1.

Rollers 36 are provided on member 30 for alignment with conveyors 16, 18 so that containers may easily pass from first conveyor 16 onto member 30 and subsequently be ejected therefrom onto second conveyor 18. Guide members 38 and 40 are provided on member 30 for guiding the containers and maintaining their orientation, relative to bag discharge aperture 28, as the containers pass from first conveyor 16 onto member 30 and, after insertion of a liquid filled bag thereinto, onto second conveyor 18. Guide member 40 also serves as a "retention means" for retaining the container in position on member 30 when it is raised into the position shown in FIGS. 2 and 4.

Bag inserter 10 further comprises "container placement means" for placing an empty container on member 30 so that the container bag receiving aperture will be precisely aligned with bag discharge aperture 28 when the container is raised into position relative to funnel 20. In the preferred embodiment, the container placement means comprises a pair of pneumatic cylinders 42, 44 having extendible rods 46, 48 respectively to which end stops 50, 52 are respectively affixed.

The operation of the preferred embodiment will now be described with reference to FIGS. 3 through 7. Empty containers 54, 56, 58, 60, etc. are supplied via first conveyor 16. The containers each have end and side closure flaps 62, 64 and 66 which remain open to expose container bag receiving aperture 68, through which the liquid filled bag is to be inserted into the container. The containers arrive at member 30 at a known orientation; namely, that shown in FIG. 3.

Initially, rods 46 and 48 are extended. This enables the first container 54 to pass from first conveyor 16 onto rollers 36 until container 54 contacts end stops 50, 52 which ensure that container 54 remains in position on member 30 with container bag receiving aperture 68 aligned with bag discharge aperture 28. Photo cell 70 (FIGS. 7A and 7B) serves as a "container placement detector means" by detecting the presence of container 54 on member 30 when container 54 comes to rest against end stops 50, 52. Upon such detection, photo cell 70 produces an output signal which energizes solenoid 72 which in turn actuates pneumatic cylinder 34, thereby causing the cylinder to extend and raise container 54 into the position shown in FIG. 4. As member 30 raises, it actuates a "container lifted detector means"; namely limit switch 78, which produces an output signal to energize solenoid 80, which in turn actuates pneumatic cylinders 42 and 44. Rods 46 and 48 are thereupon retracted within cylinders 42, 44 to the position shown in FIG. 4, in which end stops 50, 52 serve to restrain containers 56, 58 and 60 on first conveyor 16.

Figure 4:
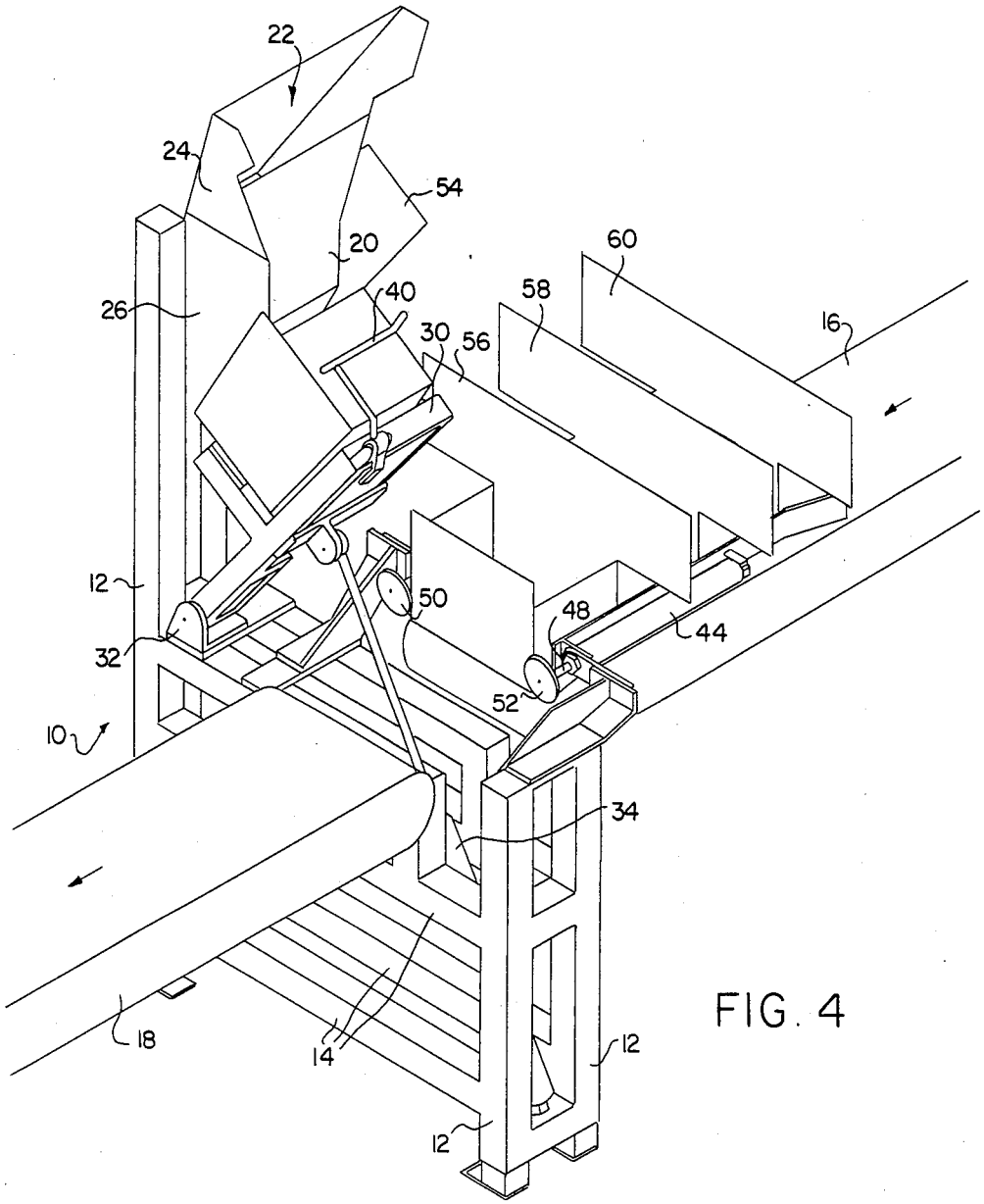
FIG. 4 shows actuation of the container positioning means to position the container relative to the funnel and also shows retention of the remaining empty containers on the first conveyor.
Figure 5:
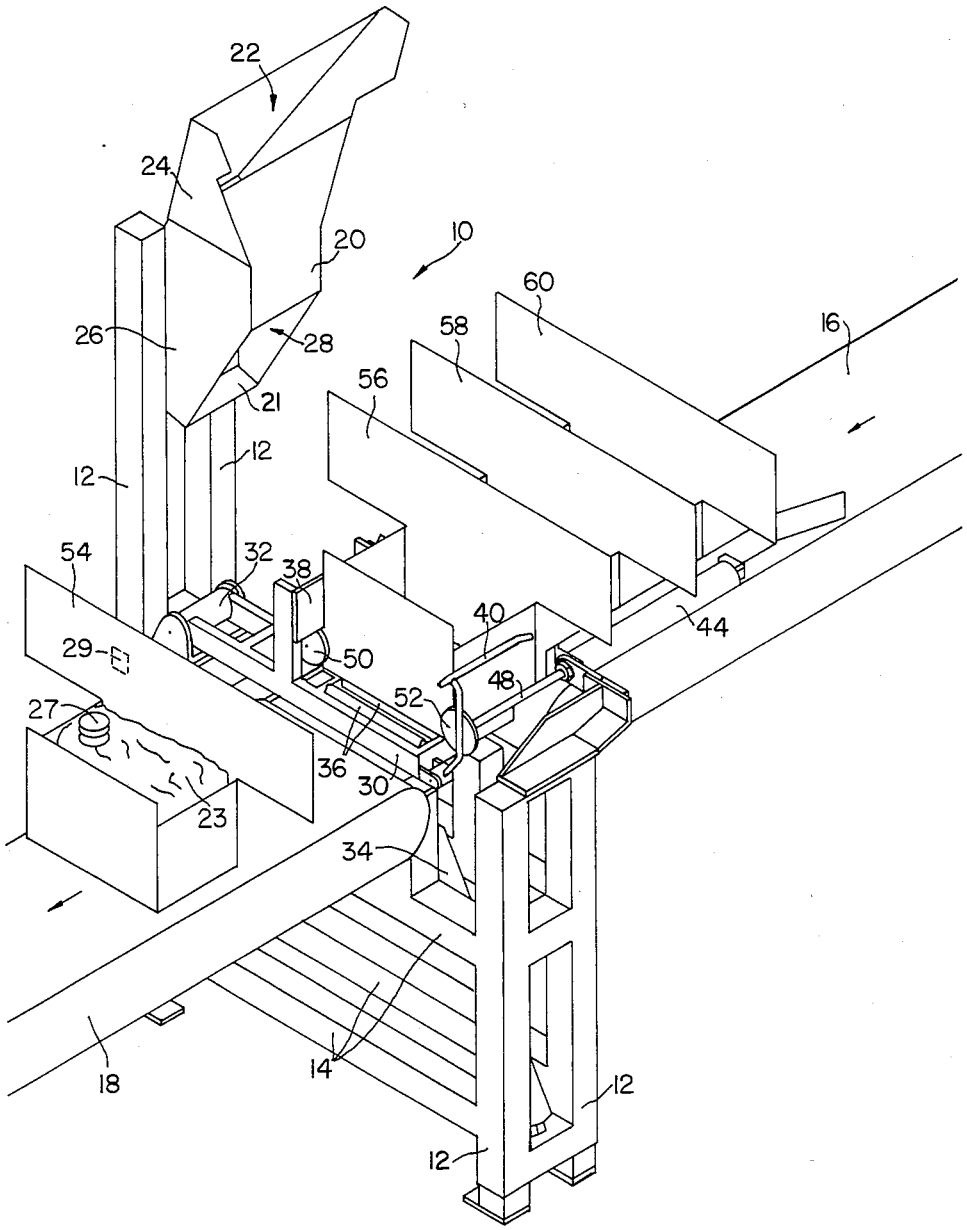
FIG. 5 shows the liquid filled bag-containing container ejected onto the second conveyor and the next sequential empty container placed in position on the container positioning means.
Figure 6:
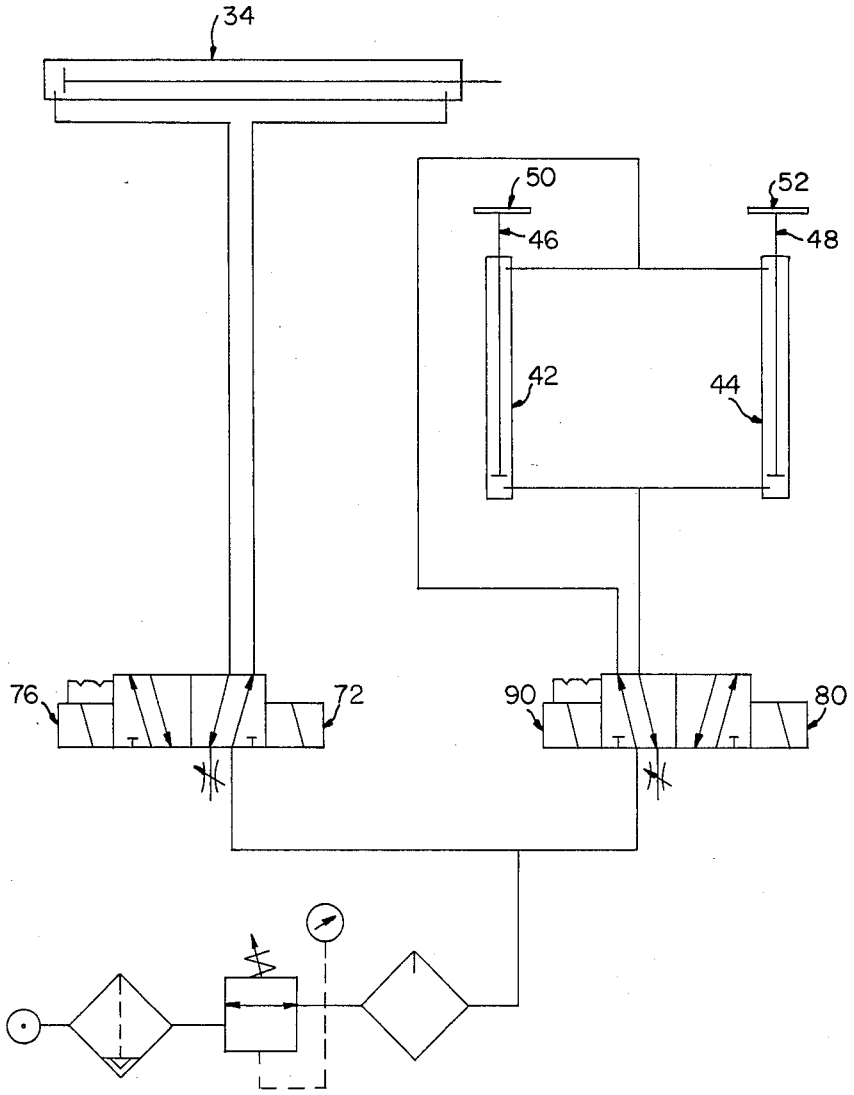
FIG. 6 is a pneumatic circuit diagram which illustrates the operation of the pneumatic cylinders, solenoids and valves of the preferred embodiment.
Figure 7A:
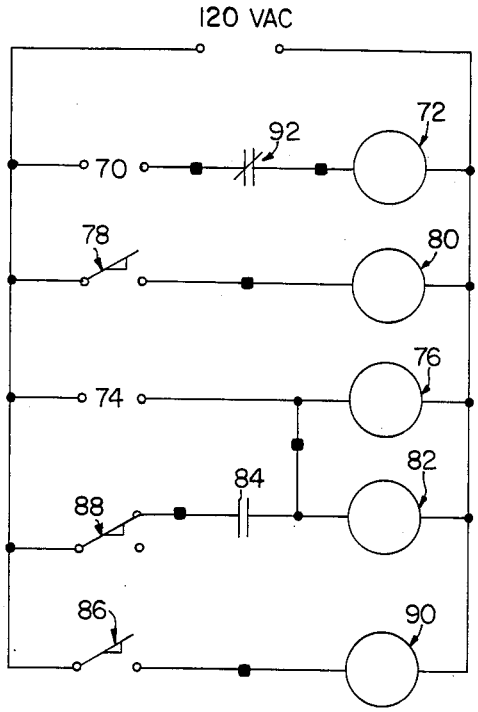
FIG. 7A and 7B are somewhat schematic electric circuit diagrams which illustrate the electrically actuated components of the preferred embodiment.
Figure 7B:
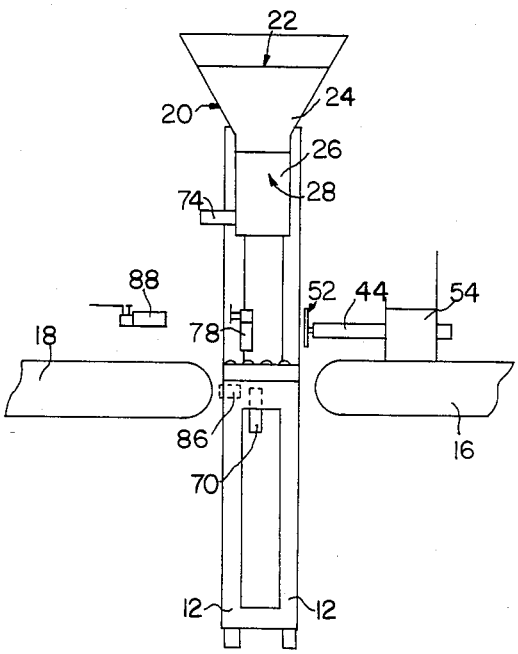

Photo cell 74 serves as a "container filled detector means" by detecting passage of the liquid filled bag from funnel 20 into container 54, and then producing an output signal to energize solenoids 76 and 82. Solenoid 76 in turn actuates cylinder 34 by retracting its rod within the cylinder, thereby lowering liquid filled bag containing container 54 on member 30 back down into the position shown in FIG. 3, except that end stops 50, 52 remain retracted as shown in FIG. 4. Relay 82, when energized, opens contact 92 and closes contact 84, which in turn maintains relay 82 in the energized state. As member 30 reaches the bottom of its travel, it actuates a "container lowered detector means"; namely, limit switch 86, which produces an output signal to energize solenoid 90, which in turn actuates pneumatic cylinders 42 and 44, thus extending rods 46, 48 and end stops 50, 52 to eject liquid filled bag-containing container 54 from member 30 onto second conveyor 18 for further processing, and admitting container 56 from first conveyor 16 onto member 30 for repetition of the cycle. As container 54 travels along second conveyor 18 it actuates limit switch 88, which de-energizes relay 82 and in turn closes contact 92 and opens contact 84, thus readying bag inserter 10 for repetition of the cycle.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

We claim:

1. Bag inserter apparatus for inserting a liquid filled bag into a pre-selected position within a container, said apparatus comprising:

(a) a funnel for receiving and guiding said bag into said container, said funnel comprising:
  (i) a bag receiving aperture for guiding said bag into a tapered bag forming section of said funnel;
  (ii) a bag discharge chute beneath said bag forming section;
  (iii) a bag deflector plate at the lower end of said chute;
  (iv) a bag discharge aperture formed at a substantial vertical angle across the lower end of said chute; and, (b) container positioning means for offset positioning of said container relative to said chute with a bag receiving aperture of said container adjacent said discharge aperture and with a wall of said container opposite said container bag receiving aperture at approximately said angle.

2. Bag inserter apparatus as defined in claim 1, further comprising container placement means for placing said container on said container positioning means, for subsequent positioning of said container adjacent said funnel by said container positioning means.

3. Bag inserter apparatus as defined in claim 2, wherein said container placement means comprises an extendible cylinder for (a) stopping travel of said container at a selected position on said container positioning means;
(b) restraining passage of additional containers toward said container positioning means; and,
(c) ejecting said container from said container positioning means after insertion of said bag into said container.

* * * * *